US008061082B2

(12) United States Patent
Garries et al.

(10) Patent No.: US 8,061,082 B2
(45) Date of Patent: Nov. 22, 2011

(54) WINDOW LATCH

(75) Inventors: Ray Garries, Fox Island, WA (US); Gary Brunold, Klamath Falls, OR (US); Tim Laurance, Klamath Falls, OR (US); Nick Strahm, Klamath Falls, OR (US); James Ripley, Canton, SD (US); Steve Piltingsrud, Sioux Falls, SD (US); Scott Meunier, Sioux Falls, SD (US)

(73) Assignee: JELD-WEN, inc., Klamath Falls, OR (US)

( * ) Notice: Subject to any disclaimer, the term of this patent is extended or adjusted under 35 U.S.C. 154(b) by 709 days.

(21) Appl. No.: 11/971,641

(22) Filed: Jan. 9, 2008

(65) Prior Publication Data

US 2009/0173009 A1 Jul. 9, 2009

(51) Int. Cl.
*E05D 15/22* (2006.01)

(52) U.S. Cl. ..... 49/185; 49/181

(58) Field of Classification Search ..... 49/176, 49/183, 184, 185, 449, 492.1; 292/137, 163, 292/DIG. 20, 175, 42, 164, 145, DIG. 47; 70/89, 90

See application file for complete search history.

(56) References Cited

U.S. PATENT DOCUMENTS

| | | | | |
|---|---|---|---|---|
| 126,872 | A | | 5/1872 | Buckman |
| 417,868 | A | | 12/1889 | Janes |
| 534,185 | A | | 2/1895 | Winchester |
| 543,226 | A | | 7/1895 | Atwood |
| 769,767 | A | | 9/1904 | Phelps |
| 804,994 | A | | 11/1905 | Andrews |
| 897,719 | A | | 9/1908 | Daubaignan |
| 1,003,386 | A | | 9/1911 | Welker |
| 1,279,353 | A | | 9/1918 | Kelly et al. |
| 1,485,382 | A | | 2/1923 | Foley |
| 1,656,818 | A | | 1/1928 | Williamson |
| 4,400,026 | A | | 8/1983 | Brown |
| 4,553,353 | A | * | 11/1985 | Simpson ..... 49/161 |
| 4,791,756 | A | | 12/1988 | Simpson |
| 4,824,154 | A | | 4/1989 | Simpson |
| 4,923,230 | A | | 5/1990 | Simpson |
| 5,127,685 | A | * | 7/1992 | Dallaire et al. ..... 292/175 |
| 5,139,291 | A | * | 8/1992 | Schultz ..... 292/42 |
| 5,248,174 | A | | 9/1993 | Matz et al. |
| 5,301,989 | A | * | 4/1994 | Dallmann et al. ..... 292/142 |
| 5,536,052 | A | | 7/1996 | Maier |
| 5,553,903 | A | | 9/1996 | Prete et al. |
| 5,575,116 | A | | 11/1996 | Carlson et al. |
| 5,669,180 | A | | 9/1997 | Maier |

(Continued)

*Primary Examiner* — Jerry Redman
(74) *Attorney, Agent, or Firm* — Stoel Rives LLP

(57) ABSTRACT

A latch for use in a window comprising a bottom sash mounted in a window frame, the latch comprising a housing comprising a top wall, a bottom wall, a pair of opposed sidewalls and a rear wall. A top edge of the rear wall and a rear edge of each sidewall define a rear aperture. A front edge of the top wall, the bottom wall and each of the sidewalls defines a front aperture, the front aperture and the rear aperture opening into a bolt cavity defined by the housing. A bolt is slidably received by the housing, the bolt comprising a body with a front portion and a rear portion. The body is slidably received in the bolt cavity between a first position in which the front portion of the bolt is extended outwardly through the front aperture and the rear portion of the body engages an outer surface of the housing, and a second position in which the rear portion is disengaged from the housing. The rear portion of the bolt extends outwardly through the rear aperture in both the first and second positions.

17 Claims, 9 Drawing Sheets

U.S. PATENT DOCUMENTS 5,669,639 A * 9/1997 Lawrence ..... 292/175
5,671,958 A 9/1997 Szapucki et al.
5,675,937 A 10/1997 Stebel
5,806,900 A 9/1998 Bratcher et al.
5,943,822 A * 8/1999 Slocomb et al. ..... 49/181
5,970,656 A 10/1999 Maier
5,996,283 A 12/1999 Maier
6,021,603 A * 2/2000 Prete et al. ..... 49/183
6,155,615 A * 12/2000 Schultz ..... 292/163
6,178,696 B1 1/2001 Liang
6,183,024 B1 * 2/2001 Schultz et al. ..... 292/175
6,230,443 B1 * 5/2001 Schultz ..... 49/183
6,364,375 B1 4/2002 Szapucki et al.
6,484,444 B1 11/2002 Polowinczak
6,485,070 B1 * 11/2002 Schultz ..... 292/175
RE37,916 E 12/2002 Szapucki et al.
6,572,158 B2 6/2003 Szapucki et al.
6,604,324 B1 8/2003 Maier
6,722,712 B2 * 4/2004 Schultz ..... 292/175
6,832,792 B2 * 12/2004 Polowinczak et al. ..... 292/36
6,845,593 B2 1/2005 Silverman
6,874,826 B1 * 4/2005 Polowinczak et al. ..... 292/175
6,883,272 B2 4/2005 Maier
6,948,278 B1 * 9/2005 Schultz ..... 49/185
7,096,626 B2 8/2006 Heng et al.
7,171,784 B2 * 2/2007 Eenigenburg ..... 49/181
7,222,458 B2 * 5/2007 Polowinczak et al. ..... 49/181
2003/0167694 A1 9/2003 Liang
2005/0011131 A1 1/2005 Liang et al.
2005/0156434 A1 * 7/2005 Polowinczak et al. ..... 292/175
2005/0193630 A1 9/2005 Marshik et al.
2006/0028028 A1 * 2/2006 Schultz ..... 292/175
2006/0260197 A1 11/2006 Fullick
2006/0284424 A1 12/2006 Newbould et al.
2007/0137109 A1 * 6/2007 Tremble et al. ..... 49/185
2007/0222234 A1 9/2007 Liang et al.
2009/0223130 A2 * 9/2009 Ozawa ..... 49/185
2010/0037524 A1 * 2/2010 Liang et al. ..... 49/176

* cited by examiner

WINDOW LATCH

FIELD OF THE INVENTION

The present invention relates generally to window latches. More particularly, the present invention relates to a window latch that may be used to selectively limit the ability to pivot a sash in which the latch is mounted relative to the frame in which the sash is mounted.

BACKGROUND OF THE INVENTION

Double-hung windows are commonly used in residential and other structures. Double-hung window assemblies typically include a window frame and a pair of window sashes. The bottom sash may be positioned inwardly of the top sash so that the sashes overlap and can be slid vertically relative to one another along the guide rails of the window frame. Window sashes can be made of wood, extruded plastic frame members or metal frame members joined at the corners, for example, to form a generally rectangular frame in which the glazing is installed.

Double-hung windows often include a locking mechanism located at or near the point where the sashes meet when the window assembly is in a closed position. A locking mechanism may be fixed on the top rail of the bottom sash and the corresponding latch-receiving mechanism is fixed on the bottom rail of the top sash. When the window sashes are in the closed position, the lock may be secured to prevent movement of the sashes.

Many double-hung windows also include latches (including, for example, tilt or vent latches) that are typically mounted on the opposing ends of the top rail of the bottom sash. The tilt latches generally are manually activated to selectively engage portions of the window frame, for example, grooves formed therein. When in an extended position, the tilt latches engage the window frame, thereby preventing the bottom sash from pivoting relative to the window frame, yet allowing the bottom sash to be slid relative to the frame in a vertical direction. In a retracted position, the tilt latches allow the bottom sash to be pivoted outwardly from the frame, thus allowing easy access to the outer surface of the panel housed within the bottom sash. Tilt latches can also be incorporated into the top sash to allow similar pivoting motion relative to the window frame.

SUMMARY OF THE INVENTION

The present invention recognizes and addresses considerations of prior art constructions and methods. In one exemplary embodiment of the present invention, a latch for use in a window with a top sash and a bottom sash slidably mounted in a window frame comprises a housing comprising a top wall, a bottom wall, a pair of opposed sidewalls extending between the top wall and the bottom wall and a rear wall extending both upwardly from the bottom wall and between the opposed sidewalls. A top edge of the rear wall and a rear edge of each sidewall define a rear aperture. A front edge of the top wall, the bottom wall and each of the sidewalls define a front aperture, the front aperture and the rear aperture open into a bolt cavity defined by the housing. A bolt is slidably received by the housing, the bolt comprising a body with a front portion and a rear portion. The body is slidably received in the bolt cavity and is configured to reciprocate between a first position in which the front portion of the body is extended outwardly through the front aperture and the rear portion of the body engages an outer surface of the housing, and a second position in which the rear portion of the body is disengaged from the outer surface of the housing. The rear portion of the body extends outwardly through the rear aperture in both the first and second positions.

Another exemplary embodiment of the invention comprises a window assembly with a window frame, a top sash and a bottom sash, the bottom sash being slidably mounted in the window frame, and a latch disposed in the bottom sash. The latch includes a housing comprising a top wall, a bottom wall, a pair of opposed sidewalls extending between the top wall and the bottom wall and a top plate. The top plate and the top wall define a slot therebetween at a front end of the housing. A front edge of the top wall, the bottom wall and each of the sidewalls define a front aperture, the front aperture opening into a bolt cavity defined by the housing. A bolt is slidably received by the housing, the bolt comprising a body with a front portion and a rear portion. The body is slidably received in the bolt cavity between a first position in which the front portion of the bolt is extended outwardly through the front aperture such that the front portion engages a portion of the window frame and a second position in which the front portion is disengaged from the window frame. The slot defined by the top wall and the top plate is configured to receive a portion of the bottom sash such that the top plate is adjacent an outer surface of the bottom sash and the top wall is adjacent an inner surface of the bottom sash.

Yet another exemplary embodiment of the invention provides a method of making a latch for use in a window with a top sash and a bottom sash slidably mounted in a window frame. The method comprises providing a housing comprising a top wall, a bottom wall, a pair of opposed sidewalls extending between the top wall and the bottom wall, and a rear wall extending both upwardly from the bottom wall and between the opposed sidewalls. A top edge of the rear wall and a rear edge of each sidewall define a rear aperture. A front edge of the top wall, the bottom wall and each of the sidewalls define a front aperture, the front aperture and the rear aperture open into a bolt cavity defined by the housing. A bolt is provided that is slidably received by the housing, the bolt comprising a body with a front portion and a rear portion. The body is slidable in the bolt cavity and is configured to reciprocate between a first position in which the front portion of the body is extended outwardly through the front aperture and the rear portion of the body engages an outer surface of the housing and a second position in which the rear portion of the body is disengaged from the outer surface of the housing. The rear portion of the bolt extends outwardly through the rear aperture in both the first and second positions.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
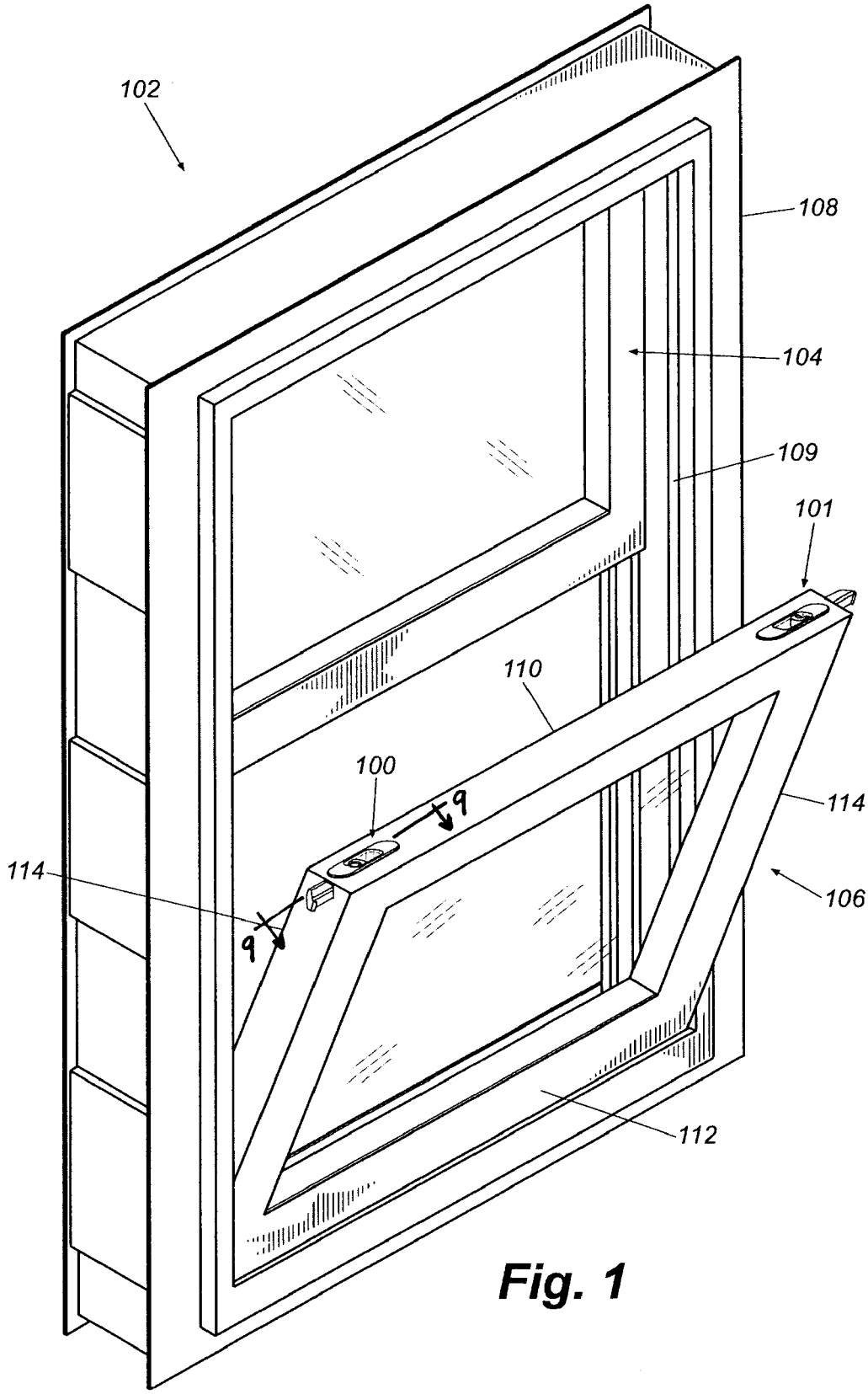
FIG. 1 is a perspective view of a window with an embodiment of a latch according to the present invention, installed in the bottom sash of the window.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to FIG. 1, a pair of left side and right side window latches 100 and 101, respectively, in accordance with the present invention is shown mounted on an upper surface of a top rail 110 of a bottom sash 106 of a window assembly 102. Bottom sash 106 also includes a bottom rail 112 and a pair of stiles 114 extending between corresponding ends of top rail 110 and bottom rail 112. As shown, window latches 100 and 101 are mounted at opposing ends of top rail 110 so that each is adjacent a vertical member of a window frame 108 of window assembly 102. As such, as discussed in greater detail below, window latches 100 and 101 can be used to selectively engage a portion of window frame 108, thereby either allowing or preventing pivoting motion of bottom sash 106 relative to window frame 108 other than the differences required for use on opposing sides of the sash, left side and right side window latches 100, 101 are identical in construction and material properties.

When window latches 100 and 101 engage guide slots 109 formed in the inwardly facing surfaces of the vertical members of window frame 108, bottom sash 106 is limited to being slidably moved in a vertical direction within window frame 108. Disengaging both window latches 100 and 101 from their respective guide slots 109 enables bottom sash 106 to be pivoted away from window frame 108, as shown in FIG. 1. In the position shown, bottom rail 112 of bottom sash 106 remains vertically slidable within window frame 108. In the preferred embodiment shown, either top sash 104, bottom sash 106, or both sashes, may be slidably moved within window frame 108, such that a ventilation space is created at the top, bottom, or top and bottom, of window assembly 102, respectively. As well, top sash 104 may be pivoted relative to window frame 108 in a manner similar to that which is described below for bottom sash 106.

Figure 2A:
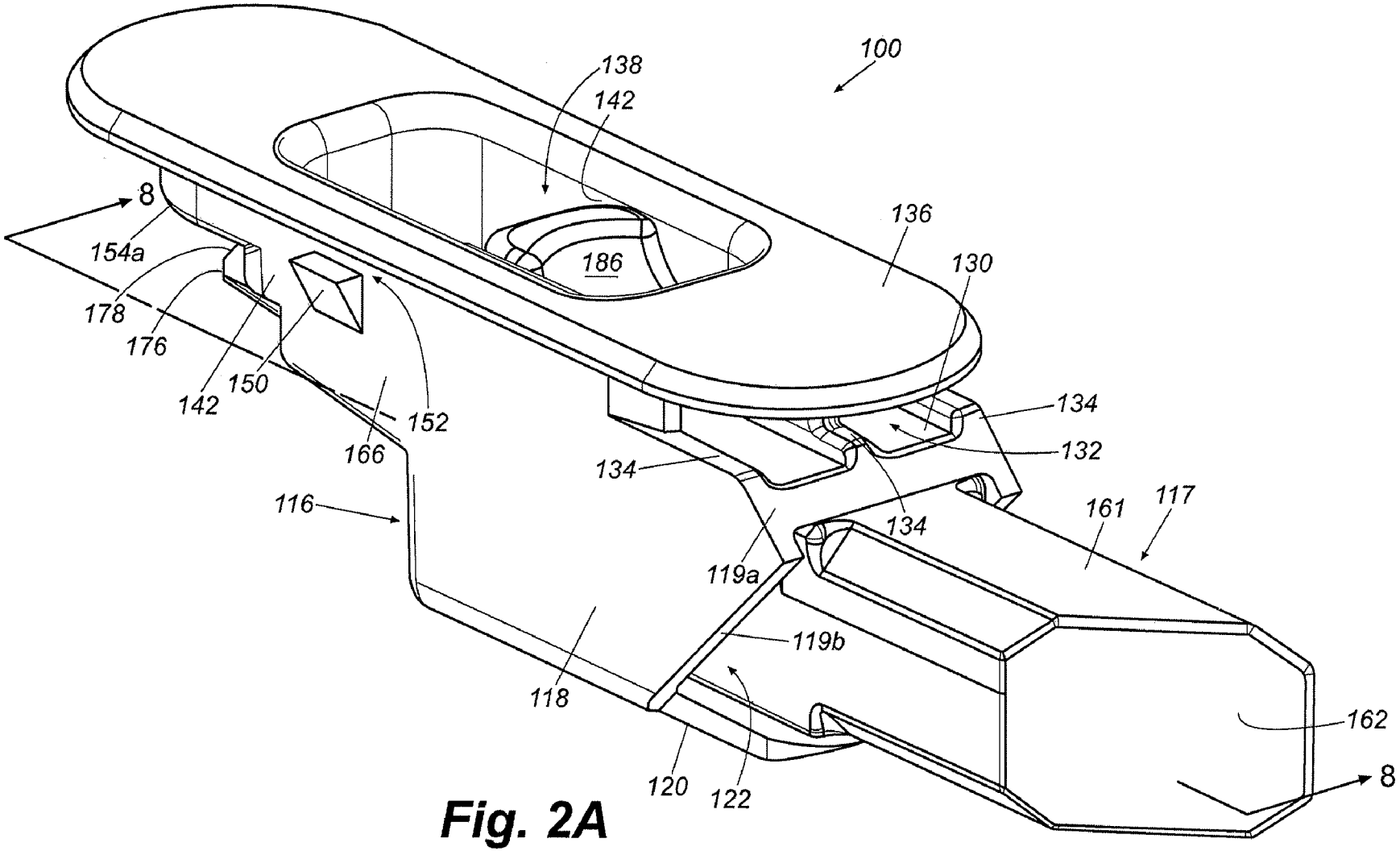
FIGS. 2A and 2B are perspective views of the window latch as shown in FIG. 1 with the bolt in the extended and retracted positions, respectively.
Figure 2B:
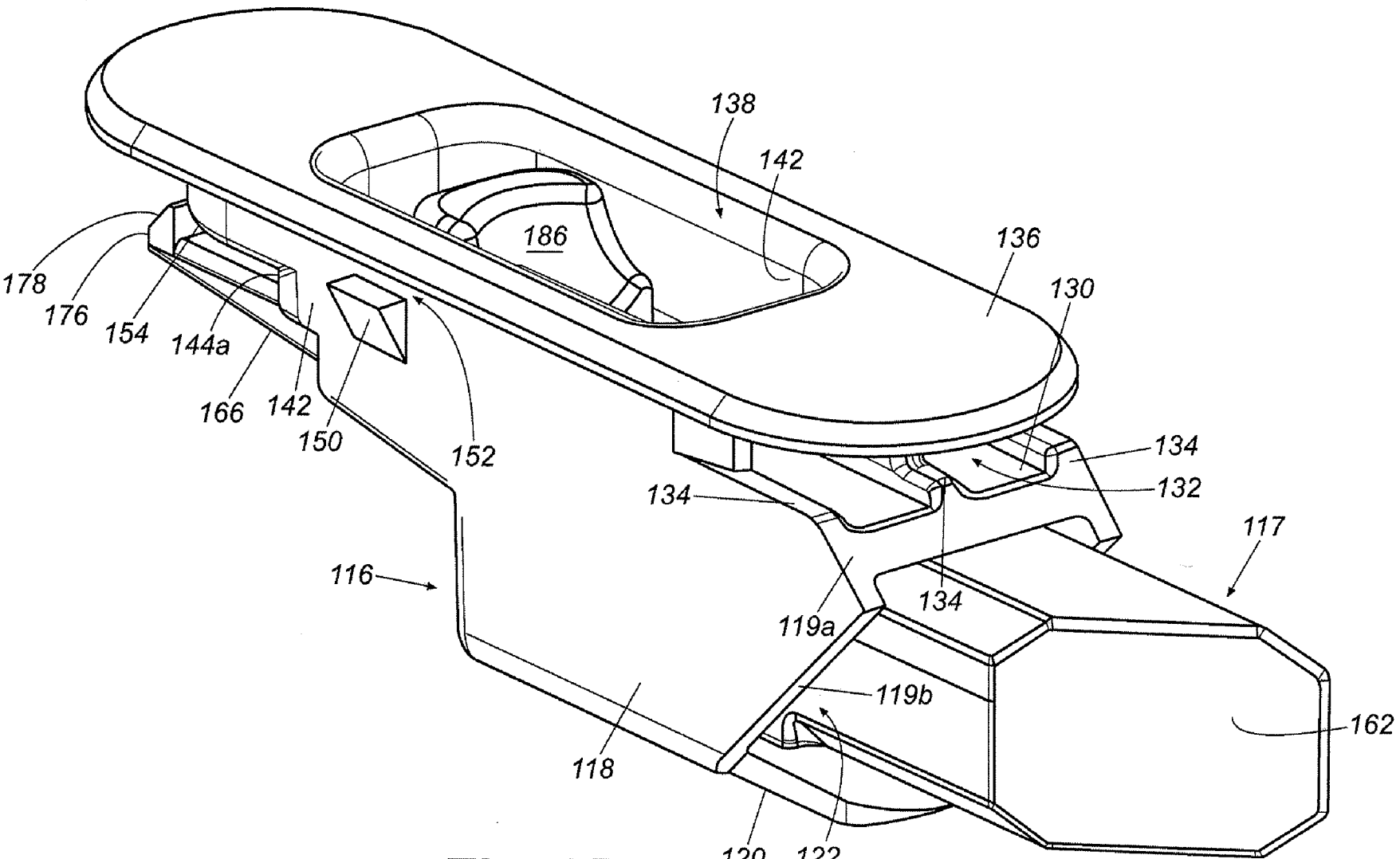

Referring to FIGS. 2A and 2B, a preferred embodiment of the left window latch 100 is shown. For ease of description, because of the similarities between the left side and right side window latches 100 and 101, only the left side window latch 100 is discussed below. Window latch 100 includes a housing 116 and a latch bolt 117 slidably mounted therein. FIG. 2A shows window latch 100 with latch bolt 117 in a first, or extended, position in which a nose 162 of latch bolt 117 extends fully beyond a front aperture 122 of housing 116. As well, in the first position, a mounting catch 176 of latch bolt 117 engages housing 116, thereby limiting outward motion of latch bolt 117 relative to the house. In this position, nose 162 of latch bolt 117 can engage its respective guide slot 109 (FIG. 1) of window frame 108. As such, window latch 100 prevents pivotal motion of bottom sash 106 relative to window frame 108 while still allowing relative vertical sliding motion of bottom sash 106 relative to top sash 104 within window frame 108. FIG. 2B shows window latch 100 with latch bolt 117 in a second, or retracted, position in which nose 162 of latch bolt 117 is retracted, partially, into a bolt cavity 125 defined by housing 116 and mounting catch 176 no longer engages housing 116. So positioned, although nose 162 of latch bolt 117 still extends partially through front aperture 122, latch bolt 117 no longer engages its respective guide slot 109 of window frame 108, as discussed in great detail below. As such, bottom sash 106 may now be pivoted away from window frame 108.

Figure 3:
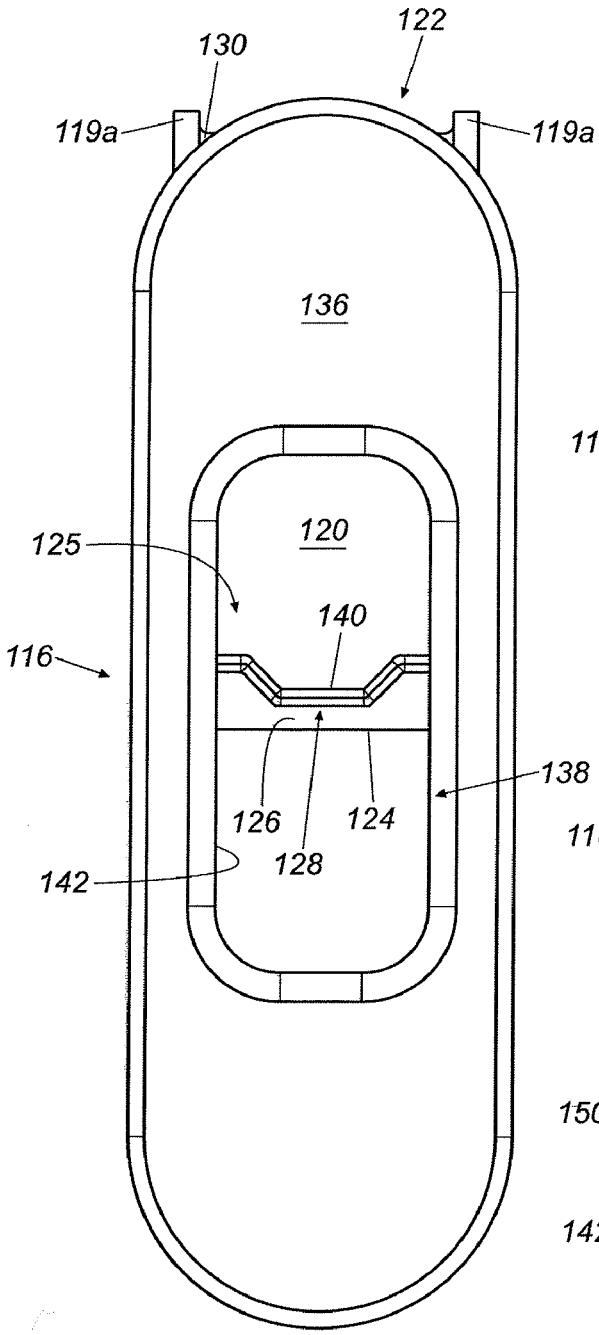
FIG. 3 is a top view of the housing of the window latch as shown in FIG. 1.
Figure 4:
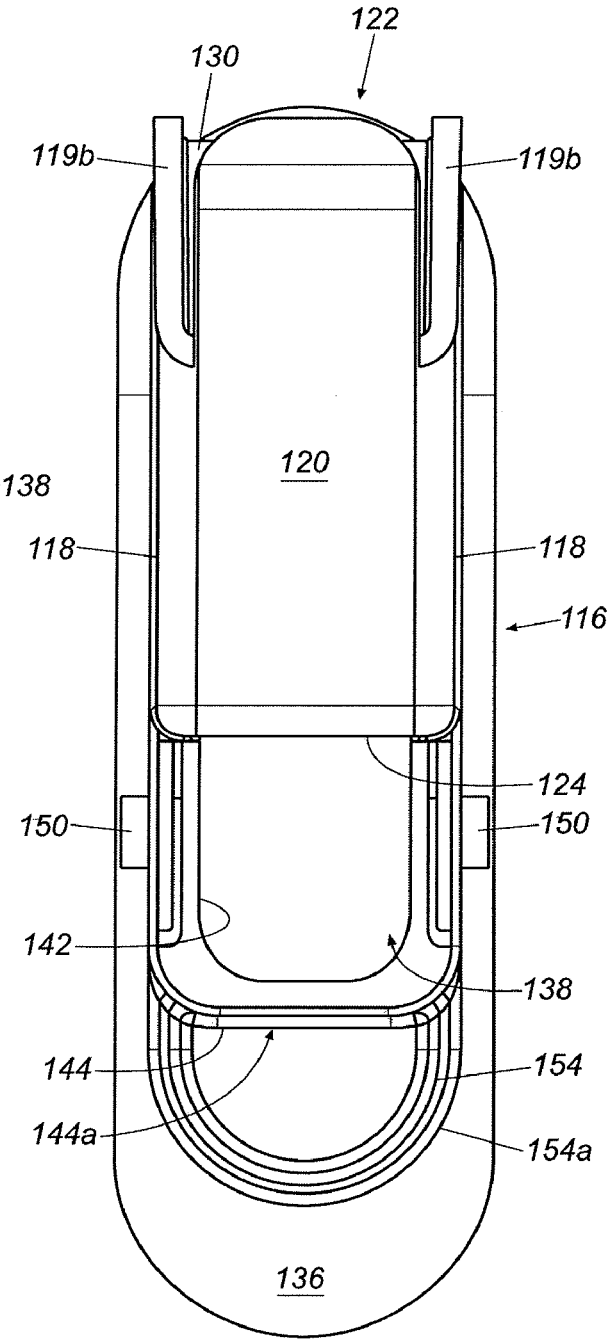
FIG. 4 is a bottom view of the housing of the window latch as shown in FIG. 1.

Referring now to FIGS. 3 and 4 as well, housing 116 includes a pair of opposed sidewalls 118, a bottom wall 120, a back wall 124 and a top wall 130. Sidewalls 118 are parallel to each other and extend upwardly from a top surface of bottom wall 120 to a bottom surface of top wall 130 such that each sidewall 118 is perpendicular to both bottom wall 120 and top wall 130. Back wall 124 extends upwardly from the top surface of bottom wall 120 and also extends between respective rear edges of opposed sidewalls 118. Back wall 124 extends upwardly from bottom wall 120 for only a portion of the height of opposed side walls 118 (FIG. 8). A top edge 126 of back wall 124 and the exposed portions of rear edges 118*a* (FIG. 8) of opposed side walls 118 define a rear aperture 128. Rear aperture 128 is configured to slidably receive a portion of body 160 of latch bolt 117 during operation of window latch 110, as discussed in greater detail below. Back wall 124 also defines a recess 140 (see also FIG. 8) that is configured to receive an end of a biasing member 192 (FIG. 7) when window latch 100 is assembled, as discussed in greater detail below.

Opposed side walls 118, bottom wall 120, back wall 124 and top wall 130 define a bolt cavity 125 having a rectangular cross-section relative to the longitudinal access of housing 116. Front edges 119 of sidewalls 118 each include an upper portion 119*a* and a lower portion 119*b*. Each upper portion 119*a* extends downwardly from top wall 130 toward the front end of housing 116 while each lower portion 119*b* extends upwardly from bottom wall 120 toward the front end of housing. The slanted configuration of both upper portions of opposed sidewalls 118 facilitates mounting housing 116 of window latch 100 in a corresponding mounting recess 156 (FIGS. 9A through 9D), as discussed in greater detail below.

As best seen in FIGS. 2A and 2B, housing 116 includes a top plate 136 that is parallel to top wall 130. Top plate 136 is connected to opposed sidewalls 118 and top wall 130 by a downwardly depending wall 142 that defines an actuator aperture 138. Top plate 136 and top wall 130 define a slot 132 therebetween that is configured to slidably receive a portion of the sash rail in which housing 116 is mounted, as is discussed in greater detail below. As shown, a plurality of ridges 134 extend upwardly from top wall 130 that are configured to firmly secure housing 116 to the portion of the sash rail that is slidably received therein.

A pair of opposed mounting tabs 150 extend outwardly from the outer surface of downwardly depending wall 142. A slot 152 is formed between a top surface of each mounting tab 150 and a bottom surface of top plate 136. Each slot 152 receives a portion of sash rail 110 when mounting housing 116 in its corresponding mounting recess 156 (FIGS. 9A through 9D). Each mounting tab 150 includes an angled camming surface to facilitate mounting housing 116 and the top surface of each mounting tab 150 is configured to engage an inner surface of the sash rail in which housing 116 is mounted. A mounting wall 154 extends rearwardly beyond a rear portion 144 of downwardly depending wall 142. Mounting wall 154 is configured to be received in a friction fit with a correspondingly shaped rear portion of the mounting recess in which housing 116 is mounted. Preferably, an outer surface 154*a* of mounting wall 154 abuts the inner periphery of the corresponding mounting recess along substantially its entire length.

Figure 5:
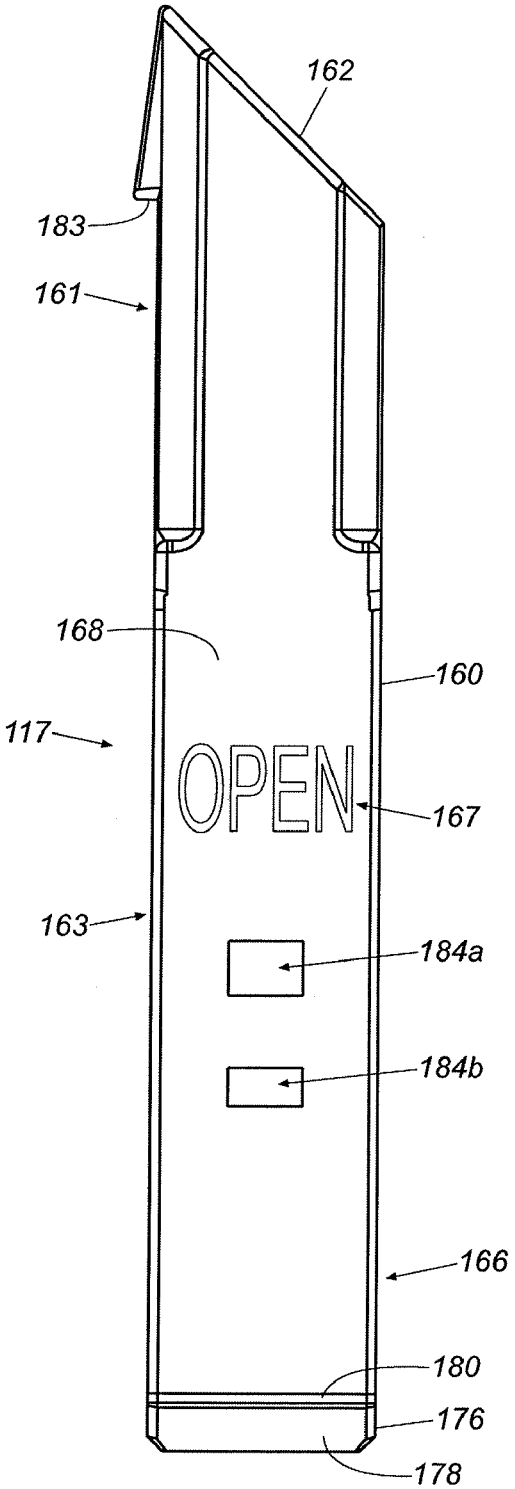
FIG. 5 is a top view of the bolt of the window latch as shown in FIG. 1.
Figure 6:
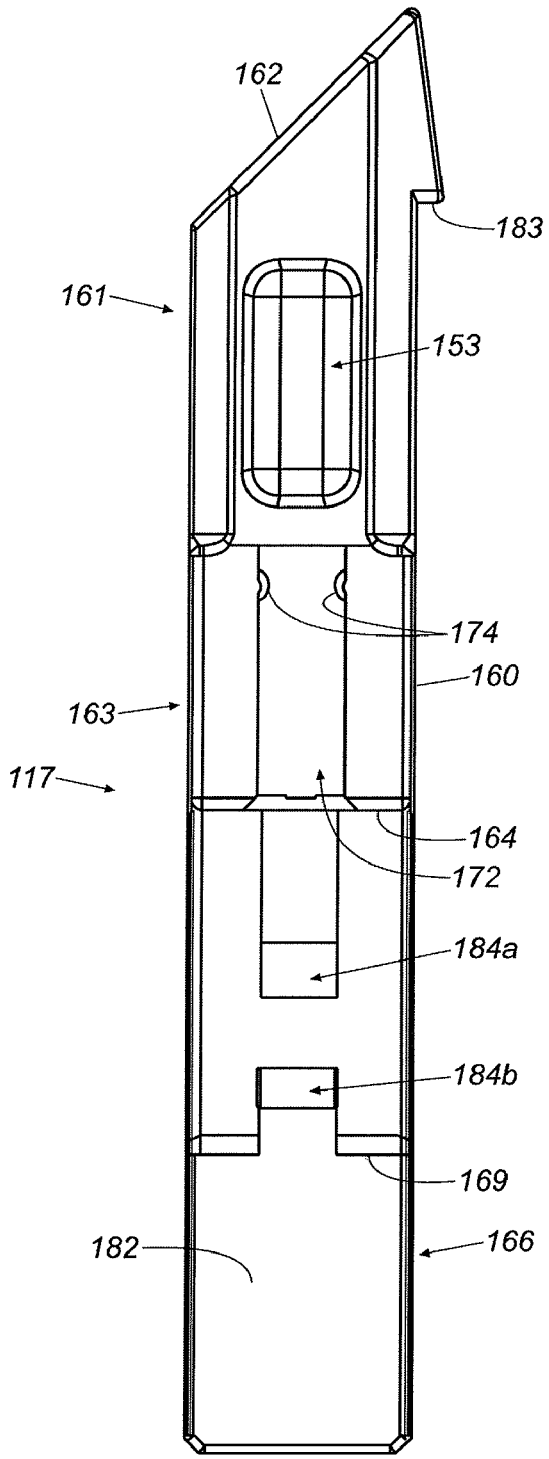
FIG. 6 is a bottom view of the bolt of the window latch as shown in FIG. 1.

Referring now to FIGS. 5 and 6, latch bolt 117 includes a body 160 with a front portion 161, a middle portion 163 and a rear portion 166. Front portion 161 of body 160 includes nose 162 that is configured to selectively engage a corresponding guide slot 109 formed in window frame 108 (FIG. 1). As best seen in FIG. 1, nose 162 is configured such that if the window sill in which window latch 100 is pivoted closed without retracting latch bolt 117 into bolt cavity 125 (FIG. 2B), latch bolt 117 is cammed inwardly into bolt cavity 125 as nose 162 engages the corresponding vertical member of window frame 108. A catch 183 extends outwardly from front portion 161 of latch bolt 117 to help insure that nose 162 of latch bolt 117 is not inadvertently disengaged from the corresponding guide slot 109 when bottom sash 106 is in the closed position. As shown, a cavity 153 is formed in the bottom surface of front portion 161 in order to reduce the amount of material required to manufacture latch bolt 117.

As best seen in FIG. 6, middle portion 163 of body 160 defines a recess 172 that is configured to slidably receive an end of biasing member 192 (FIG. 7) during assembly. A pair of retaining bumps 174 depend inwardly into recess 172 from opposing side walls of recess 172. Retaining bumps 174 are configured to engage the end of biasing member 192 that is inserted into recess 172, thereby retaining biasing member 192 in recess 172 during the assembly of window latch 100. A pair of actuator mounting recesses 184*a* and 184*b* extend through middle portion 163 of body 160 and are configured to receive a first leg 188 and a second leg 190 of actuator button 186 (FIG. 7), respectively. Indicia 167 is provided on a top surface 168 of body 160 to indicate that latch bolt 117 is not in the fully extended position and, therefore, that bottom sash 106 is not necessarily adequately secured in the closed position. More specifically, when latch bolt 117 is in the fully extended position, indicia 167 is hidden from view by a portion of housing 116. However, if any portion of indicia 167 is within view, latch bolt 117 is at least partially retracted into housing 116, as discussed in greater detail below. In the embodiment shown, indicia 167 comprises the word "OPEN" etched into top surface 168 of latch bolt 117. However, other embodiments can include words and/or symbology such as an open padlock to indicate the window latch bolt is not fully extended.

Rear portion 166 of body 160 includes a mounting catch 176 disposed along its back edge. Mounting catch 176 includes a camming surface 178 and an abutting surface 180. Camming surface 178 is configured to facilitate insertion of latch bolt 117 into housing 116 during assembly, whereas abutting surface 180 is configured to retain latch bolt 117 within housing 116, as discussed in greater detail below.

Figure 7:
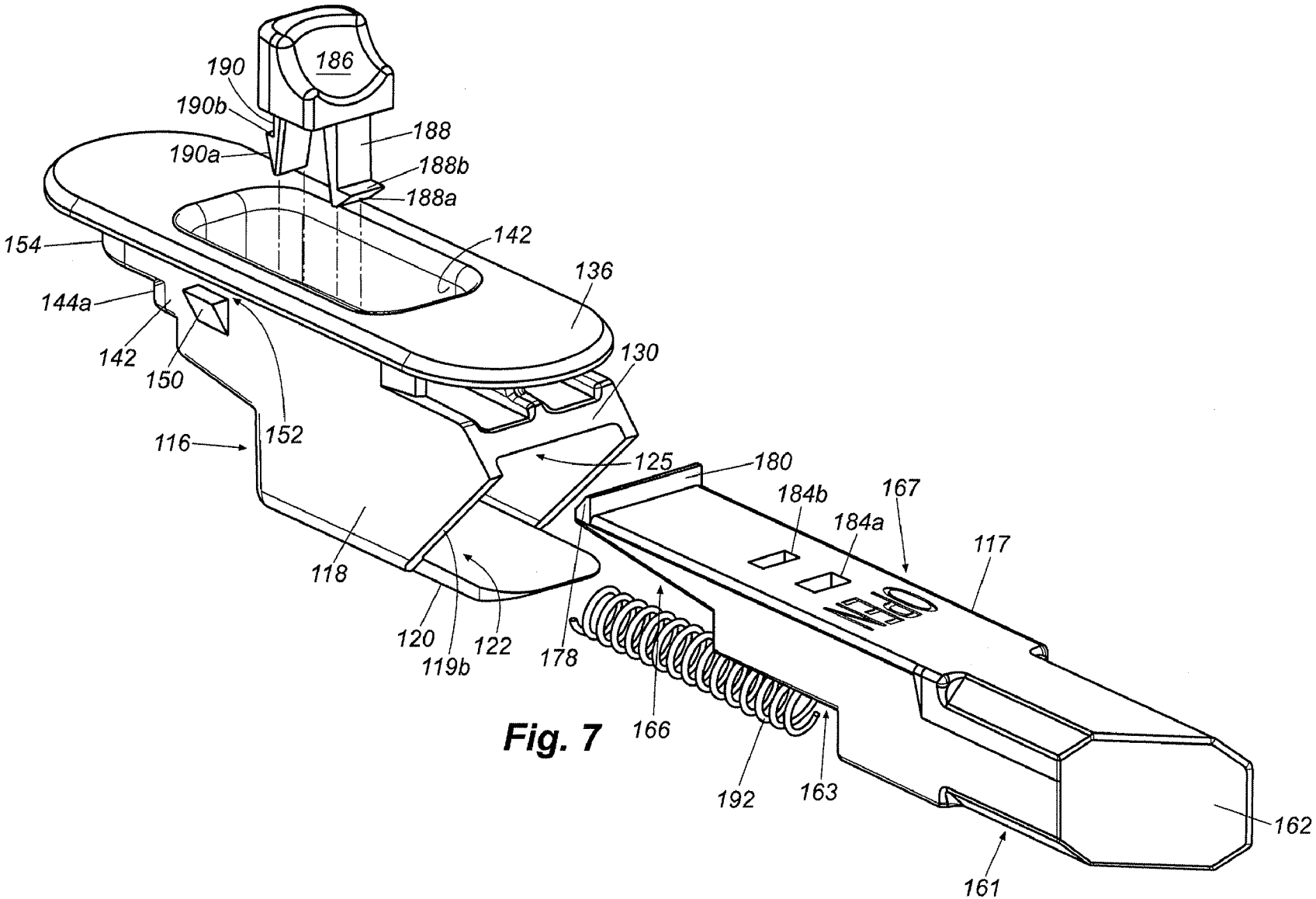
FIG. 7 is an exploded perspective view of the window latch shown in FIG. 1.
Figure 8:
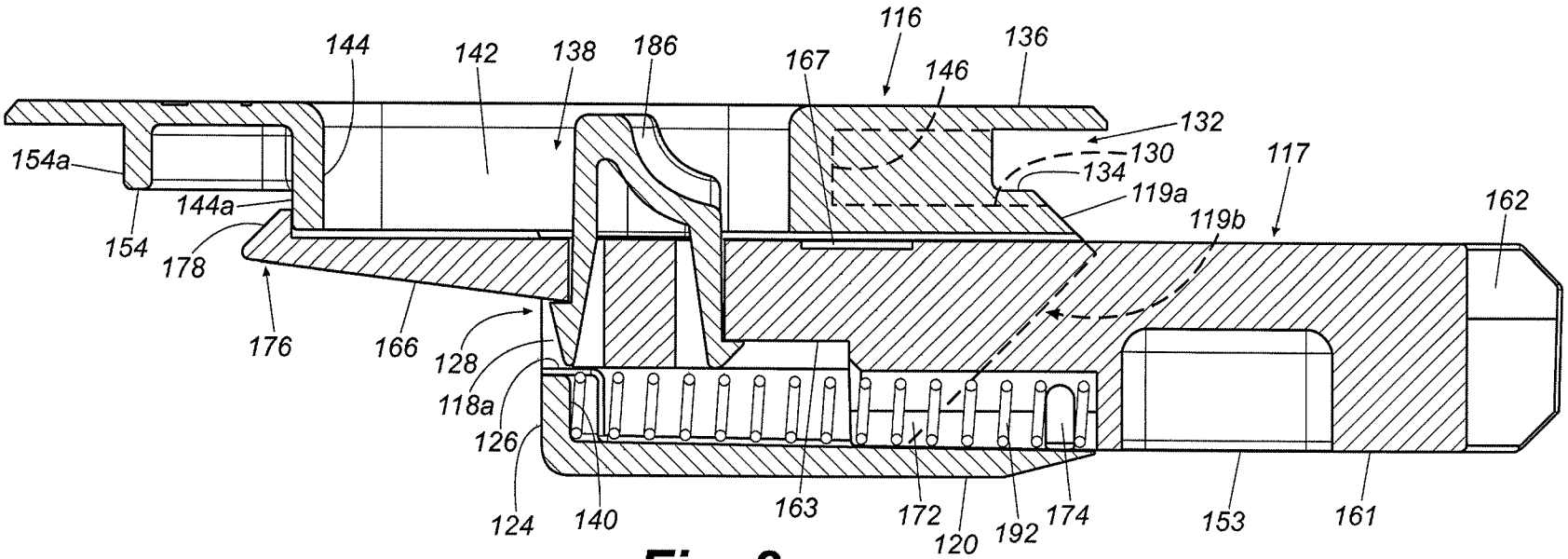
FIG. 8 is a cross-sectional view of the window latch shown in FIG. 1, taken along lines 8-8.

Referring now to FIGS. 7 and 8, to assemble latch bolt 117 and housing 116 of the preferred embodiment shown, rear portion 166 of body 160 is aligned with front aperture 122 of housing 116. One end of biasing member 192 is inserted in recess 172 of body 160 such that retaining bumps 174 engage the end of biasing member 192, thereby retaining biasing member 192 in recess 172 as window latch 100 is assembled. Rear portion 166 of body 160 is slidably inserted into bolt cavity 125 of housing 116. As latch bolt 117 is inserted into housing 116, rear portion 166 of body 160 passes through rear aperture 128 defined by back wall 124 of housing 116. Eventually, camming surface 178 of mounting catch 176 comes into contact with rear portion 144 of downwardly depending wall 142, thereby causing mounting catch 176 to be cammed away from rear portion 144 upon further insertion of latch bolt 117 into bolt cavity 125. Once mounting catch 176 is clear of rear portion 144 of downwardly depending wall 142, mounting catch 176 returns to its non-deflected position such that abutting surface 180 of mounting catch 176 engages rear surface 144*a* of rear portion 144, thereby retaining latch bolt 117 in housing 116.

As best seen in FIG. 8, as latch bolt 117 is inserted into housing 116, one end of biasing member 192 is received in recess 140 defined by back wall 124. Biasing force exerted on latch bolt 117 by biasing member 192 ensures that latch bolt 117 remains in the first position in which nose 162 of body 160 extends outwardly through front aperture 122 of housing 116, unless a user exerts rearward force on the latch bolt. An actuator button 186 is secured to latch bolt 117 by first leg 188 and second leg 190 that are received in mounting recesses 184*a* and 184*b*, respectively. Each of first leg 188 and second leg 190 includes a camming surface 188*a* and 190*a* and an abutting surface 188*b* and 190*b*, respectively. As first leg 188 and second leg 190 are inserted in the corresponding mounting recesses 184*a* and 184*b*, camming surfaces 188*a* and 190*a* cause first leg 188 and second leg 190 to deflect inwardly toward each other. Upon being fully inserted into the respective mounting recesses of latch bolt 117, first leg 188 and second leg 190 return to their non-deflected positions and actuator button 186 is secured to latch bolt 117 by abutting surfaces 188*b* and 190*b* which engage the bottom surface of latch bolt 117. As shown, actuator button 186 includes a contoured surface so that manipulation of the actuator button 186 is facilitated.

Referring now to FIGS. 1 and 9A through 9D, window latch 100 is preferably mounted in a recess 156 formed in a top rail 110 of bottom sash 106. Recess 156 is defined by a closed periphery having a rear edge 156*a* and a front edge 156*b*. Note, a bridge portion 158 defines front edge 156*b* of recess 156 and helps to maintain the structural rigidity of top rail 110 in the vicinity of recess 156. A nose aperture 157 is defined by an outer wall of stile 114 of bottom sash 106. As shown, top rail 110 and stile 114 are secured to each other by a welded seam 111.

Figure 9A:
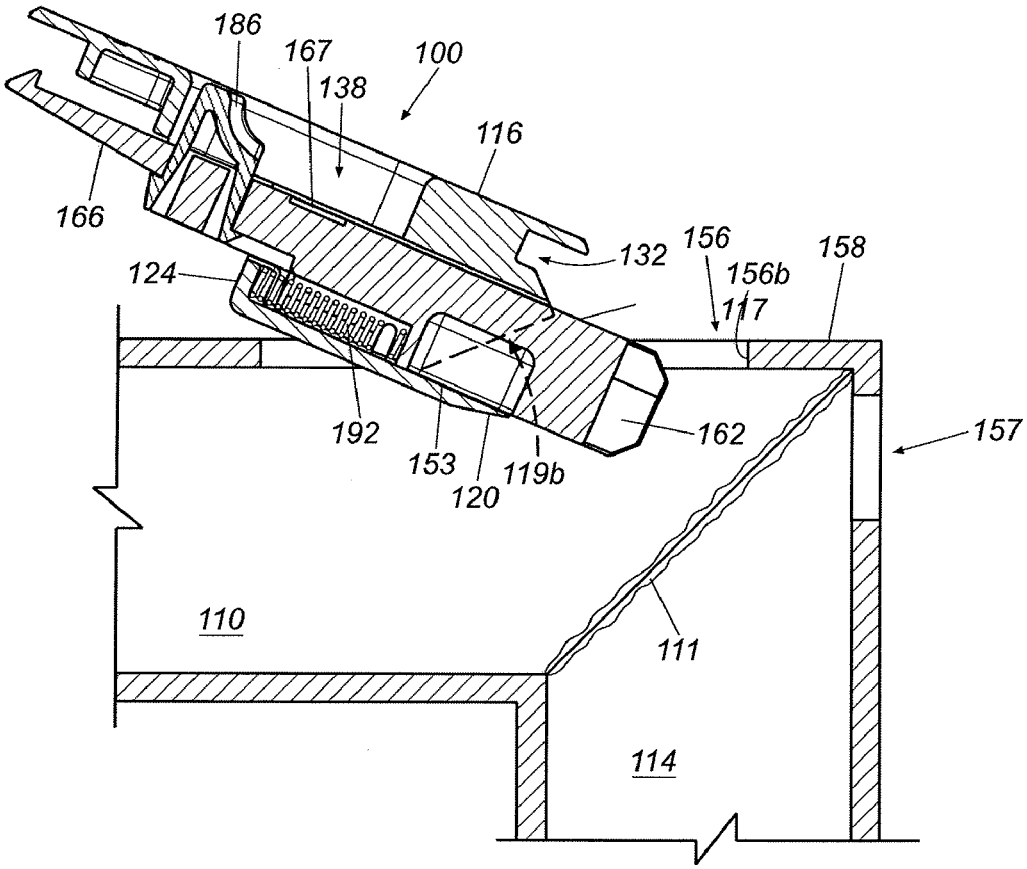
FIGS. 9A through 9D are cross-sectional views of the window latch shown in FIG. 1 being installed in a window frame.
Figure 9B:
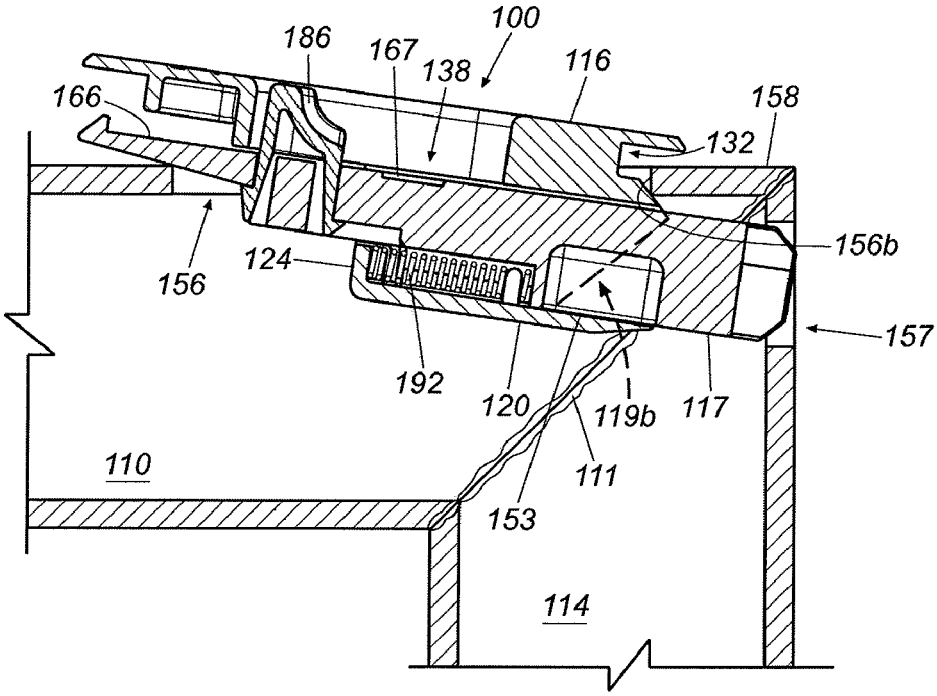

To mount window latch 100 in recess 156, actuator button 186 is moved to its rearward most position within actuator aperture 138. In this position, latch bolt 117 is in its rearward most position within bolt cavity 125 of housing 116. As best seen in FIG. 9A, nose 162 of latch bolt 117 is inserted into recess 156 and moved toward nose aperture 157. As best seen in FIG. 9B, window latch 100 is inserted into recess 156 until slot 132 of housing 116 is adjacent front edge 156*b* of recess 156. Note, upper portions 119*a* (FIG. 8) of the front edges of the opposed side walls 118 of housing 116 are sloped downwardly and forwardly from their rearward most portions to their forward most portions, which facilitates inserting window latch 100 into recess 156. As such, the overall size of recess 156 can minimized, thereby assisting and maintaining the structural integrity of top rail 110.

Figure 9C:
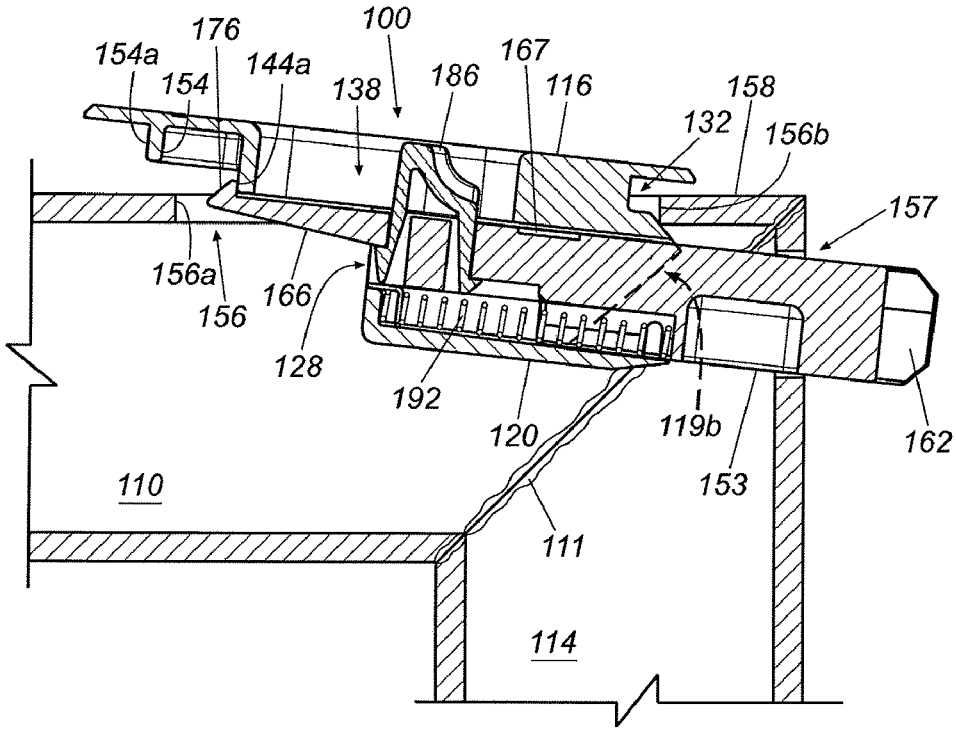
Figure 9D:
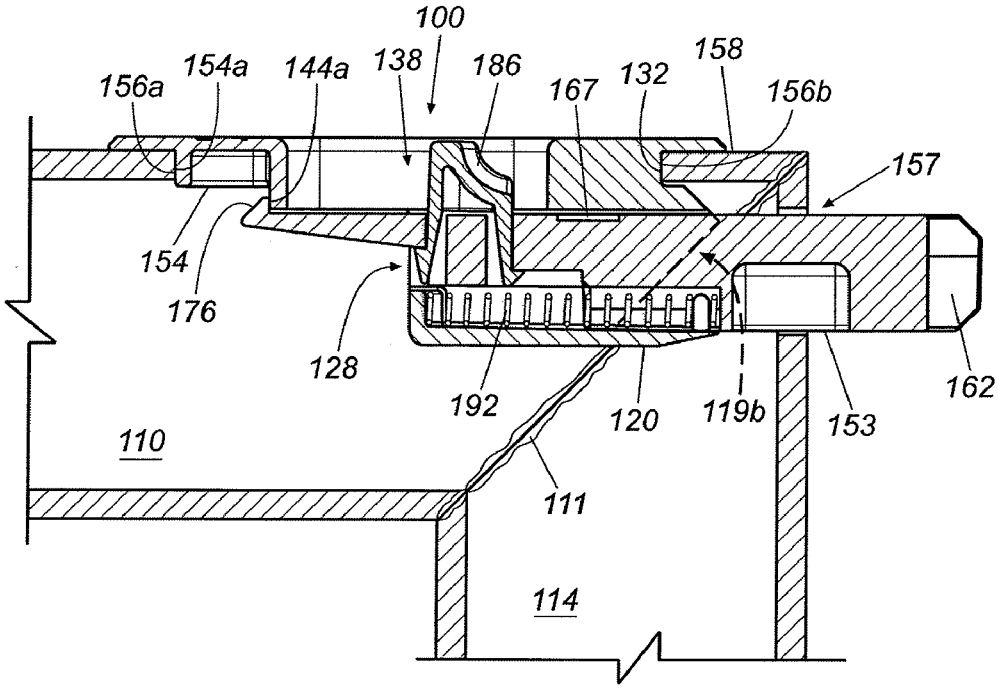

As best seen in FIG. 9C, once nose 162 of body 160 is aligned with nose aperture 157 of stile 114, rearward force on actuator button 186 is released and force exerted on latch bolt 117 by biasing member 192 causes latch bolt to return to its fully extended position. Further outward motion of latch bolt 117 relative to housing 116 is prevented by engagement of abutting surface 180 of mounting catch 176 with rear surface 144*a* of the rear portion of the downwardly depending wall. Note, in this position, rear portion 166 of latch bolt 117 has cleared rear edge 156*a* of recess 156. Next, as best shown in FIG. 9D, window latch 100 is moved forwardly until front edge 156*b* of recess 156 is received in slot 132 of housing 116. Window latch 100 is pushed downwardly into recess 156 such that an outer surface 154*a* of mounting wall 154 is received in a friction-fit adjacent rear edge 156*a* of recess 156. Additionally, as window latch 100 is seated within recess 156, opposed mounting tabs 150 (FIG. 7) are deflected slightly inwardly by the side edges of recess 156. Upon being fully seated, mounting tabs 150 return to their non-deflected positions such that they engage the inner surface of top rail 110, thereby retaining window latch 100 in recess 156.

Note, bottom portions 119*b* of the front edges of side walls 118 are slanted downwardly and rearwardly from their uppermost portions to their rearward most portions. As such, bottom portions 119*b* are disposed inwardly of welded seam 111 that connects top rail 110 to stile 114. Because front edges 119 of opposed side walls 118 do not reach welded seam 111, welded seam 111 can extend inwardly into the inner volume of bottom sash 106 without interfering with the installation of window latch 100 in top rail 110. Note also, bottom wall 120 of housing 116 extends forwardly of front edges 119 of opposed side walls 118 such that biasing member 192 remains fully enclosed over the full range of travel of latch bolt 117.

While one or more preferred embodiments of the invention are described above, it should be appreciated by those skilled in the art that various modifications and variations can be made in the present invention without departing from the scope and spirit thereof. For example, the window latch may be installed in a frame of a window that only has one slidable sash such that motion of the sash relative to the frame may be limited thereby. As well, the window latch be installed in the sash of a window in which the sashes are slid in a horizontally rather than vertically. It is intended that the present invention cover such modifications and variations as come within the scope and spirit of the appended claims and their equivalents.

What is claimed is:

1. A window sash assembly, comprising:

a sash including a top rail, a first stile attached to a first end of the top rail along a seam, a second stile attached to a second end of the top rail opposite the first end, and a bottom rail attached to the first and second stiles, the top rail and the first stile defining a cavity therein that extends between a first aperture formed in the top rail proximal of the first end and a second aperture formed in the first stile, the first aperture having a length extending in a direction between the first and second stiles and being bounded by a closed periphery having a front edge defined by a solid first bridge portion of the top rail that extends from the first aperture to the first end of the top rail, and the second aperture being bounded by a second closed periphery such that a solid second bridge portion of the first stile lies between the second aperture and the seam; and a latch assembly seated in the first aperture, the latch assembly including:

a latch housing including a top wall, a pair of opposed sidewalls extending from the top wall, and a back wall extending between the sidewalls to define a bolt cavity between the top wall, the opposed sidewalls, and the back wall, the bolt cavity opening toward the first stile, and the sidewalls being disposed inwardly of the first end of the top rail such that the seam does not interfere with the latch housing;

a latch bolt slidably mounted in the bolt cavity to reciprocate between an extended position in which a front portion of the latch bolt protrudes beyond the second aperture and a retracted position in which the latch bolt is at least partially retracted into the second aperture and into the bolt cavity;

a top plate non-moveably secured to the top wall on a side of the top wall opposite the sidewalls; and the latch housing and top plate together defining a slot within which a portion of the top rail is seated such that the top plate is adjacent an outer surface of the top rail;

wherein both the latch assembly and the latch bolt are longer than the first aperture, and the latch assembly is shaped and dimensioned for insertion into the cavity via the first aperture.

2. The assembly of claim 1, further comprising a biasing member retained in the bolt cavity between the latch bolt and the back wall of the latch housing for biasing the latch bolt toward the extended position.

3. The assembly of claim 1, wherein each of the sidewalls includes a front edge facing toward the seam, and the front edges slant downwardly and rearwardly.

4. The assembly of claim 3, wherein the latch housing further includes a bottom wall bordering the bolt cavity opposite the top wall and extending between the opposing sidewalls, the bottom wall projecting forwardly of the front edges of the sidewalls.

5. The assembly of claim 1, wherein a mounting wall of the latch assembly depends from the top plate and contacts a rear edge of the periphery of the first aperture opposite the front edge.

6. The assembly of claim 5, wherein the first aperture includes an oval shape and the mounting wall is shaped to abut the inner periphery of the first aperture substantially along an entire length of the mounting wall and to engage the inner periphery of the first aperture with a friction fit.

7. The assembly of claim 1, wherein the slot includes a side slot formed between the top plate and a mounting tab projecting from the latch housing.

8. The assembly of claim 1, wherein the slot includes a front slot between the top wall and the top plate.

9. The assembly of claim 8, further comprising:

a first mounting tab attached to one of the opposed sidewalls forming a second slot between the first mounting tab and the top plate;

a second mounting tab attached to the other of the opposed sidewalls forming a third slot between the second mounting tab and the top plate; and wherein a second portion of the top rail is captured in the second slot and a third portion of the top rail is captured in the third slot.

10. The assembly of claim 1, wherein the top rail and the first stile are both made from plastic and the seam includes a welded seam.

11. The assembly of claim 1, wherein a rear end of the latch bolt opposite the front portion of the latch bolt includes a catch that engages the latch housing to retain the latch bolt in the bolt cavity when the latch bolt is at the extended position.

12. The assembly of claim 1, wherein the top plate includes an actuator opening, and further comprising an actuator button secured to the latch bolt and extending into the actuator opening to facilitate manipulation of the latch bolt.

13. A window sash assembly, having a sash including a top rail, a first stile attached to a first end of the top rail, a second stile attached to a second end of the top rail opposite the first end, and a bottom rail attached to the first and second stiles, the top rail and the first stile defining a cavity therein that extends between a first aperture formed in the top rail proximal of the first end and a second aperture formed in the first stile, the first aperture having a length extending in a direction between the first and second stiles and being bounded by a closed periphery having a front edge defined by a solid first bridge portion of the top rail that extends from the first aperture to the first end of the top rail, and the second aperture being bounded by a second closed periphery such that a solid second bridge portion of the first stile lies between the second aperture and the seam, wherein the improvement comprises:

a seam joining the top rail to the first stile; and a latch assembly seated in the first aperture, the latch assembly including:

a latch housing including a top wall, a pair of opposed sidewalls extending from the top wall to define a bolt cavity between the top wall and the opposed sidewalls, the bolt cavity opening toward the first stile, and the sidewalls being disposed inwardly of the first end of the top rail such that the seam does not interfere with the latch housing;

a latch bolt slidably mounted in the bolt cavity to reciprocate between an extended position in which a front portion of the latch bolt protrudes beyond the second aperture and a retracted position in which the latch bolt is at least partially retracted into the second aperture and into the bolt cavity;

a top plate non-moveably secured to the top wall on a side of the top wall opposite the sidewalls; and the latch housing and top plate together defining a slot within which a portion of the top rail is seated such that the top plate is adjacent an outer surface of the top rail;

wherein both the latch assembly and the latch bolt are longer than the first aperture, and the latch assembly is shaped and dimensioned for insertion into the cavity via the first aperture.

14. A window sash assembly according to claim 13, wherein the improvement further comprises the top rail and the first stile are both made from plastic and the seam joining the top rail to the first stile includes a welded seam.

15. A window sash assembly according to claim 13, wherein the improvement further comprises:

the latch housing including a back wall extending between the sidewalls to define the bolt cavity; and a biasing member retained in the bolt cavity between the latch bolt and the back wall of the latch housing for biasing the latch bolt toward the extended position.

16. A window sash assembly according to claim 13, wherein the improvement further comprises:

the first aperture having an oval shape; and a mounting wall of the latch assembly depending from the top plate and contacting a rear edge of the first aperture opposite the front edge substantially along an entire length of the mounting wall to engage an inner periphery of the first aperture with a friction fit.

17. A window sash assembly according to claim 13, wherein the improvement further comprises the slot including a front slot between the top wall and the top plate.

* * * * *